US006722999B1

(12) United States Patent
Yi

(10) Patent No.: US 6,722,999 B1
(45) Date of Patent: Apr. 20, 2004

(54) GOLF PUTTING TRAINING DEVICE

(76) Inventor: Kwang Chol Yi, 12000 E. 16th Ave. #208, Aurora, CO (US) 80010

( * ) Notice: Subject to any disclaimer, the term of this patent is extended or adjusted under 35 U.S.C. 154(b) by 0 days.

(21) Appl. No.: 10/420,657

(22) Filed: Apr. 21, 2003

(51) Int. Cl.[7] ..... A63B 69/36
(52) U.S. Cl. ..... 473/238; 473/231
(58) Field of Search ..... 473/216, 226, 473/231, 257, 238, 228, 268

(56) References Cited

U.S. PATENT DOCUMENTS 3,198,525 A * 8/1965 Smith ..... 473/238
3,262,705 A * 7/1966 Nunziato ..... 473/238
3,273,892 A * 9/1966 Nolting ..... 473/238
3,298,693 A * 1/1967 Eisenberg ..... 473/238
3,844,569 A * 10/1974 Swanson ..... 473/231
3,951,415 A * 4/1976 Stuart ..... 473/238
4,167,268 A * 9/1979 Lorang ..... 473/238
4,174,838 A * 11/1979 Paschetto ..... 473/238
4,306,721 A * 12/1981 Doyle ..... 473/238
4,789,158 A * 12/1988 Chiesa ..... 473/238
4,949,971 A * 8/1990 Thornton ..... 473/238
5,143,376 A * 9/1992 Johnson ..... 473/228
5,605,509 A * 2/1997 Gray ..... 473/237
5,665,007 A * 9/1997 Tatum ..... 473/238
5,762,564 A * 6/1998 Schang ..... 473/238

* cited by examiner

*Primary Examiner*—Raleigh W. Chiu
(74) *Attorney, Agent, or Firm*—Edwin H. Crabtree; Ramon L. Pizarro; Donald W. Margolis

(57) ABSTRACT

A golf putting training device for quickly attaching to a golf putter and used on a practice putting green without interfering with other golfers practicing on the same putting green. The training device helps teach the fundamentals of putting a golf ball with proper line of sight over the center of a putter head and the center of a golf ball. The golf putting training device includes a putter shaft attachment housing adapted for adjustably mounting along a length of a golf putter shaft. The shaft includes a lower end attached to the putter head. One end of a first and second brace are releasably attached to the attachment housing. An opposite end of the first and second brace is hinged to one side of a ball alignment arm. The ball alignment arm includes a sight gap along a length of the arm. The sight gap is used to position the alignment arm directly over a center of the golf ball and next to the putter head. The ball alignment arm includes a first end having a telescoping first member with a pointed end and a telescoping second member with a pointed end. The telescoping first and second members are used as a guide for stroking the golf ball toward a practice golf ball cup.

13 Claims, 3 Drawing Sheets

GOLF PUTTING TRAINING DEVICE

BACKGROUND OF THE INVENTION (a) Field of the Invention

This invention relates to a training device for the game of golf and more particularly, but not by way of limitation, to a training device mounted on a golf putter for assisting a golfer in practicing and improving golf putting skills.

(b) Discussion of Prior Art

In the game of golf, half of a golfer's score comes from the putting of the golf ball. Therefore, a crucial part of the game for both amateurs and professional golfers is to practice and improve his or her golf putting skills.

Heretofore, there have been a variety of different golf putting training devices used by golf teachers and instructors to help a golfer improve his or her putting. For example, a string is suspending above and behind a golf ball on a practice putting green. The string is extended toward a practice ball cup and suspended behind the cup. The golfer then practices stroking the ball with the putter along the length of the string and toward the ball cup.

Also, two parallel golf clubs or parallel sticks can be used with a space for a golf putter head to be placed between the clubs or sticks. The clubs or sticks are aimed toward the practice ball cup. The golfer practices stroking the golf ball toward the ball cup with the clubs or sticks used as an alignment guide.

Further, a pair of parallel strings can be used as a training aid for putting. The strings are positioned directly over the golf ball. Opposite ends of the strings are mounted on a pair of boards, which are inserted into the practice green and aligned toward the direction of the ball cup. One of the parallel strings is disposed directly above the other string. Therefore, when the golfer has a proper putting stance and a proper line of sight directly over the two strings, the two strings are seen as only one sting above a center of the golf ball. The golfer then practices stroking the golf ball along the length of the strings, out a hole in one of the boards and toward the ball cup.

All of the above-mentioned training devices are attached to a practice putting green surface and not to the golf putter. Therefore, time is required in setting up and removing the devices. Also, the use of these types of training devices mounted on top of a putting surface can interfere with other golfers practicing putting on the same putting green.

None of the above-mentioned golf putting training devices specifically disclose the unique features, structure and function of the subject training device for attaching to a putter for ease in use on a practice putting green.

SUMMARY OF THE INVENTION

In view of the foregoing, it is a primary objective of the subject invention to provide a golf putting training device that can be quickly attached to a putter and used on a practice putting green without interfering with other golfers practicing on the same putting green. The training device helps teach the fundamentals of putting a golf ball and can be used by golfers with a various skill levels.

Another object of the invention is the training device can be adjusted on different types and styles of putters with a ball alignment arm positioned directly above the center of a golf ball and next to a center of a golf ball.

Still another object of the training device is the use of a pair of telescoping members with pointed ends. The telescoping members are used for alignment of the golf ball toward the cup hole. The training device is adapted for use by both right and left hand players.

A further object of the invention is the training device is easy to assemble, it is compact and it can be easily folded together for storage in a golf bag.

The golf putting training de vice includes a putter shaft attachment housing adapted for adjustably mounting along a length of a golf putter shaft. The shaft includes a lower e n d attached to a putter head. A center mark of the putter head is placed next to a center of a golf ball for stroking the ball. One end of a first and a second brace is releasably secured to the attachment housing. An opposite end of the first and second braces is hinged to one side of a ball alignment arm. The ball alignment arm includes a sight gap along a length of the center of the arm. The sight gap is used to position a golfer's vertical line of sight directly over the center of the golf ball and next to a center of the putter head. The ball alignment arm includes a first end having a first telescoping member with a pointed end and a second end having a second telescoping member with a pointed end. The first and second telescoping members are used for pointing to and aligning the ball alignment arm toward the direction of a practice ball cup.

These and other objects of the present invention will become apparent to those familiar with various types of golf putting training devices and the like when reviewing the following detailed description, showing novel construction, combination, and elements as here in described, and more particularly defined by the claims , it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
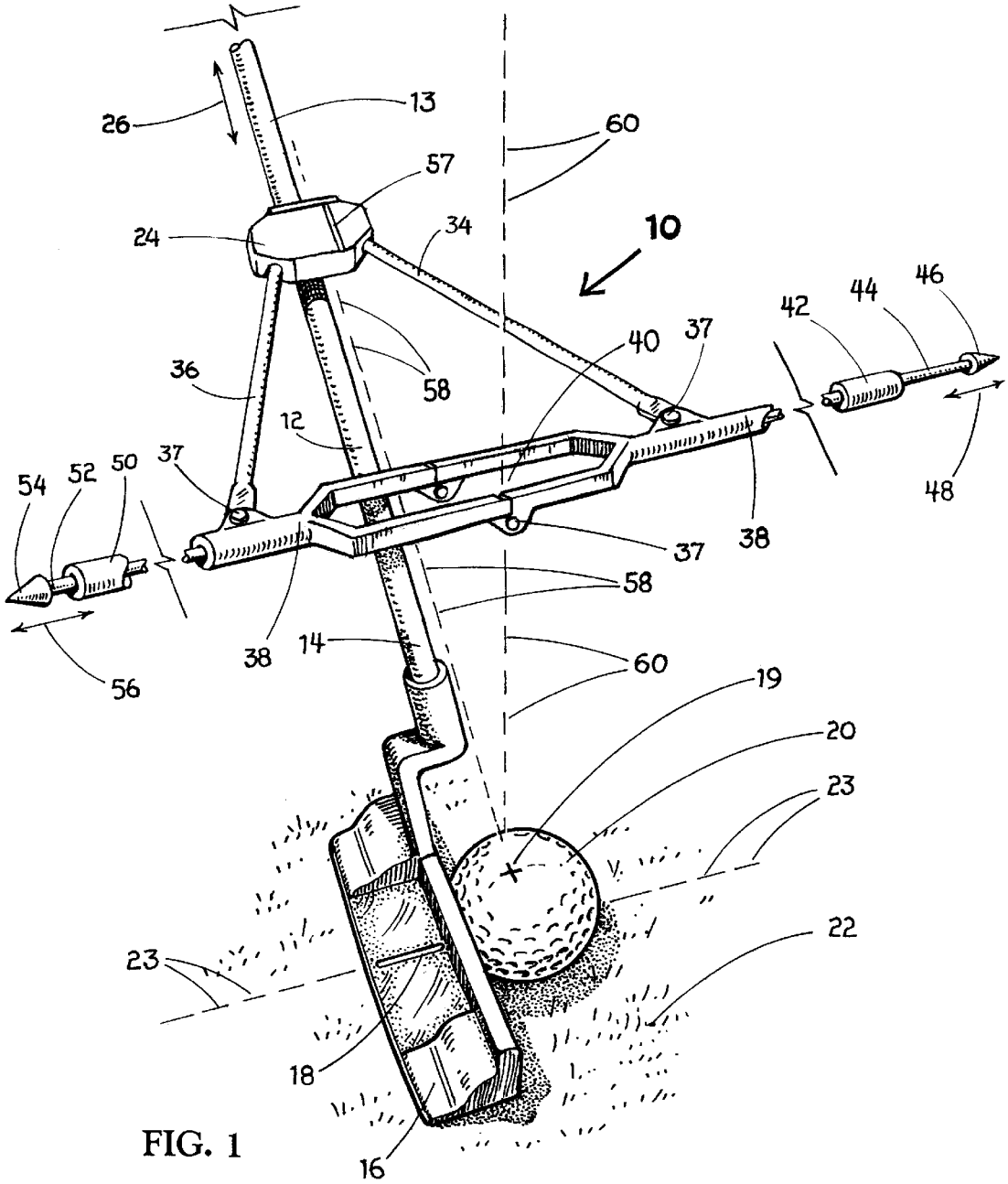
FIG. 1 is a perspective view of the golf putting training device attached to a portion of a putter shaft. The training device includes a ball alignment arm disposed over the top of a golf ball and next to a center mark of a putter head.

In FIG. 1, a perspective view of the golf putting training device is shown and having general reference numeral 10. The training device 10 is attached to a portion of a putter shaft 12 of a golf putter 13. A lower end 14 of the putter shaft 12 is attached to a putter head 16 having a center mark 18 used to align the center of the putter head 16 with a center 19 of a golf ball 20. Obviously, the putter head 16 is used for stroking the golf ball 20 on a putting green 22 and along a direction, shown as dashed lines 23, toward a practice ball cup. The practice ball cup is not shown in the drawings.

Figure 2:
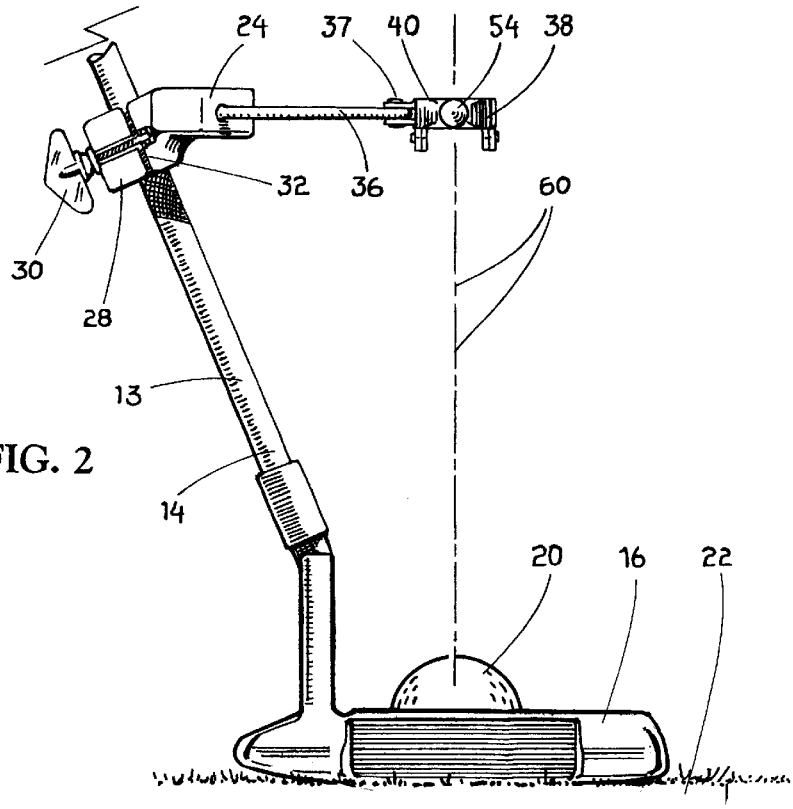
FIG. 2 is a side view of the training device as shown in FIG. 1.
Figure 3:
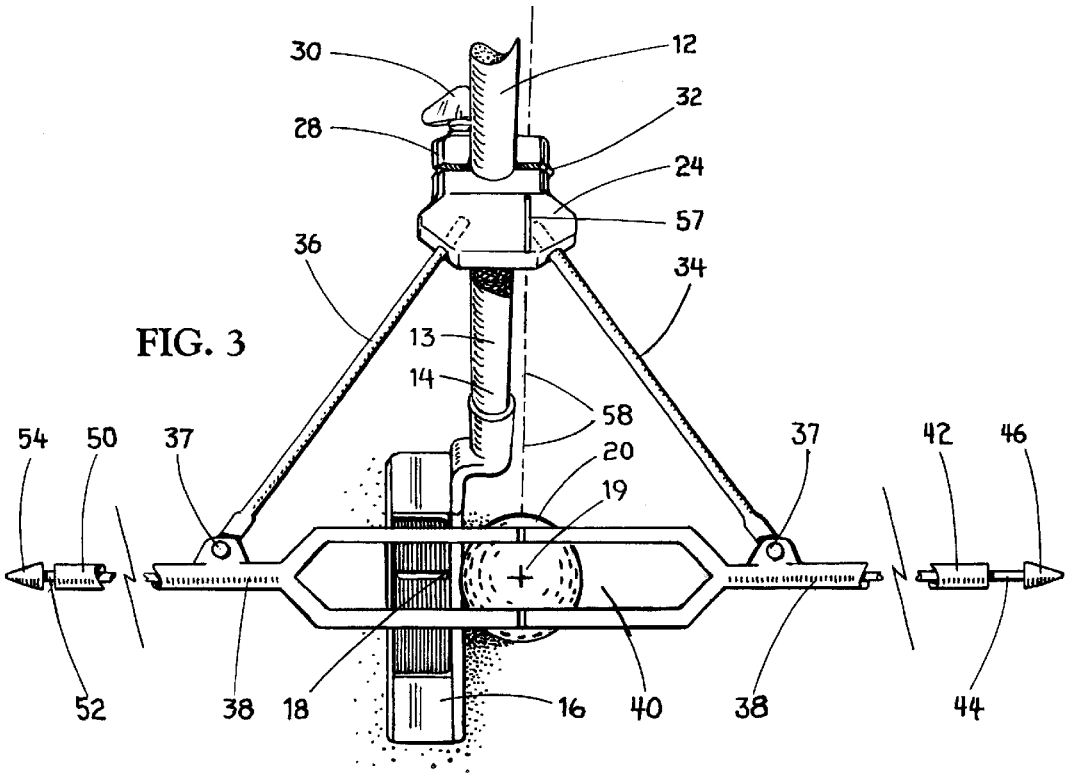
FIG. 3 is a top view of the training device as shown in FIG. 1.

The training device 10 includes a putter shaft attachment housing 24 adapted for adjustably mounting along a length, indicated by arrows 26, of the golf putter shaft 12. The attachment housing 24 includes a hinged cover 28 with a wing nut 30. By loosening the wing nut 30 and opening the cover 28 on the housing 24, a portion of the shaft 12 is received inside the housing and in a groove 32. The cover 28 is then closed and the wing nut 30 tightened after the device 10 is properly adjusted. The hinged cover 28, wing nut 30 and groove 32 are shown in FIGS. 2 and 3. Typically, the housing 24 is adjusted and attached to the putter shaft 12 approximately 12 to 24 inches above the putter head 16. This distance will vary depending on the type and design of the golf putter.

One end of a first brace 34 and a second brace 36 is releasably secured in a press fit to a lower portion of the attachment housing 24. An opposite end of the first and second braces 34 and 36 is hinged using hinges 37 mounted on one side of an elongated ball alignment arm 38. The alignment arm 38 includes a sight gap 40 along a length of the arm and centered thereon. The sight gap 40 is used by the golfer to position the alignment arm 38 directly over the center 19 of the golf ball 20. Obviously, when the golf putting training device 10 is used on different styles and lengths of putters, the device is properly adjusted along the length of the putter shaft 12 using the adjustable attachment housing 24 to position the sight gap 40 of the alignment arm 38 over the center 19 of the golf ball 20.

When the first and second braces 34 and 36 are removed from the attachment housing 24, the braces can be folded along the length of the alignment arm 38. Also, the center of the alignment arm 38 and the center along the length of the sight gap 40 is hinged using a hinge 37 for folding the arm 38 in half for ease in storage in a golf bag.

The ball alignment arm 38 includes a first end 42 having a telescoping first member 44 with a pointed end 46. The first member 44 can be telescoped in and out as shown by arrows 48. The arm 38 also includes a second end 50 having a telescoping second member 52 with a pointed end 54. The second member 52 can be telescoped in and out as shown by arrows 56. The telescoping first and second members 44 and 52 are used as alignment guides in stroking the golf ball 20 properly toward the golf ball cup.

In this drawing, the training device 10 is shown being used by a right hand golfer with the putter head 16 placed on the left side of the golf ball. A left hand golfer can use the training device 10 equally well by merely standing on the other side of the golf ball and placing the opposite side of the putter head 16 next to the golf ball.

It should be noted, the attachment housing 24 includes a ball center line mark 57. The ball centerline mark 57 is parallel to the length of the putter shaft 12 and along a centerline 58, shown in dashed lines, used for centering the alignment arm 38 over the center 19 of the golf ball. Also shown in this drawing is a vertical line of sight, shown as dashed lines 60. The vertical line of sight 60 represents the proper line of sight of the left eye of a right-handed golfer 62 directly over the center 19 of the golf ball 20.

In FIG. 2, a side view of the training device 10 is shown with the attachment housing 28 properly adjusted along the length of the putter shaft 12. The sight gap 40 of the ball alignment arm 38 is disposed directly over the center 19 of the golf ball 20. Also, the vertical line of sight 60 is shown directly over the center 19 of the golf ball 20.

In FIG. 3, a top view of the training device 10 is shown with the sight gap 40 of the ball alignment arm 38 properly centered over the center 19 of the golf ball 20. Also, the center mark 18 of the putter head 16 is shown placed next to the center 19 of the ball 20.

Figure 4A:
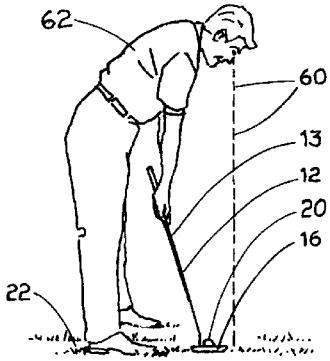
FIG. 4A is a side view of a golfer having an improper stance. The golfer is leaning to far over the golf ball and his line of sight is not directly over the center of the golf ball for the proper putting of the golf ball.

In FIG. 4A, a side view of the golfer 62 is illustrated having an improper stance. The golfer 62 is leaning to far over the golf ball 20. In this example, the golfer's vertical line of sight 60 is not directly over the center of the golf ball 20.

Figure 4B:
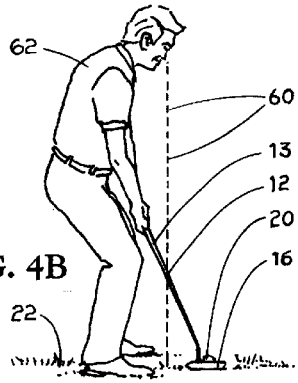
FIG. 4B is a side view of the golfer again having an improper stance. In this example, the golfer is leaning to far back from the golf ball and his line of sight is not directly over the center of the golf ball.

In FIG. 4B, a side view of the golfer 62 is shown again having an improper stance. In this example, the golfer is leaning back of the golf ball and his line of sight 60 is not directly over the center of the golf ball 20.

Figure 4C:
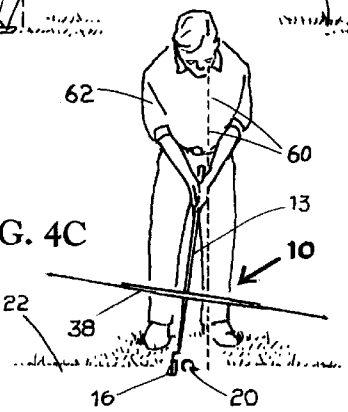
FIG. 4C is a front view of the golfer using the subject invention and having an improper stance. The golfer's line of sight is shown in front of the golf ball.

In FIG. 4C, a front view of the golfer 62 is shown using the subject training device 10 but having an improper stance. The golfer's vertical line of sight 60 is shown in front of the golf ball 20. Also, the ball alignment arm 38 is not held horizontally with the putting green 22.

Figure 4D:
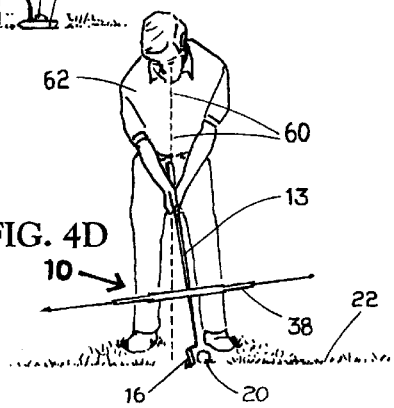
FIG. 4D is another front view of the golfer using the subject invention and having an improper stance. The golfer's line of sight in this example is shown behind the golf ball.

In FIG. 4D, another front view of the golfer 62 is illustrated using the training device 10 but having an improper stance. The golfer's line of sight in this example is shown behind the golf ball 20. Also, the ball alignment 38 is not held horizontally with the putting green 22.

Figure 5A:
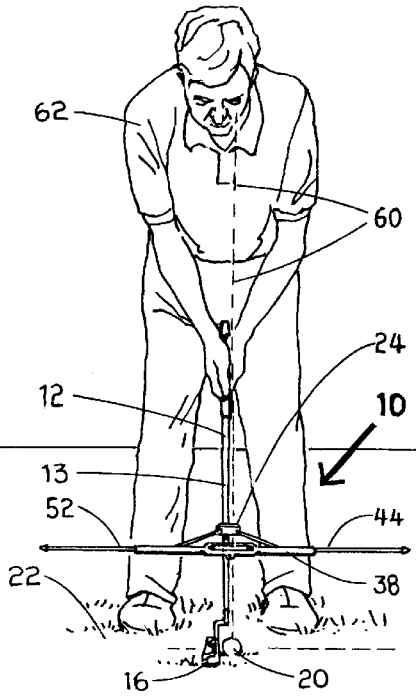
FIG. 5A is a front view of the golfer using the subject invention and having a proper stance, proper posture and a vertical line of sight over the center of the golf ball.

In FIG. 5A, a front view of the golfer 62 is shown using the subject training device 10 mounted on the putter shaft 12 with the ball alignment arm 38 properly adjusted over the center 19 of the golf ball 20. The ball alignment 38 is held horizontally above the level of the putting green 22. In this drawing, the golfer 62 has a proper putting stance and posture. Also, his vertical line of sight 60 is focused over the center 19 of the golf ball 20.

Figure 5B:
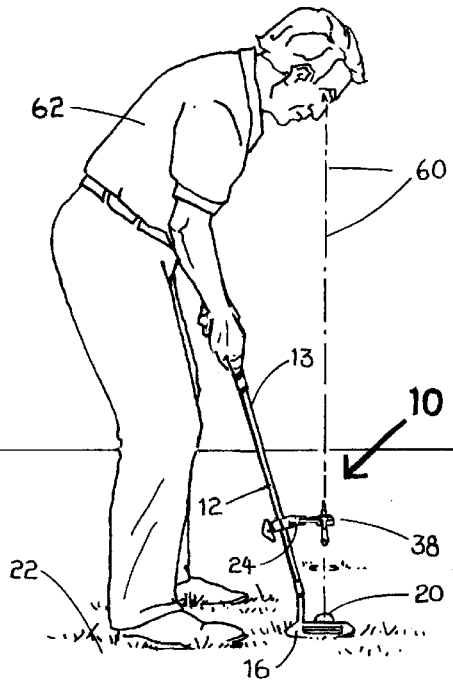
FIG. 5B is a side view of the golfer shown in FIG. 5A using the golf putter training device with the ball alignment arm disposed over the center of the golf ball and the center of the putter head.

In FIG. 5B, a side view of the golfer 62 is illustrated with the golfer having the proper stance and posture. The golfer's vertical line of sight 60 is directly over the center 19 of the ball 20.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A golf putting training device for quickly attaching to a golf putter shaft of a golf putter and disposed above a putter head attached to a lower portion of the shaft, the training device used with a golf ball on a practice putting green, the training device comprising:

attachment means adapted for adjustable mounting along a length of the golf putter shaft;

at least one brace having one end attached to said attachment means, said brace extending downwardly from said attachment means; and a ball alignment arm with a sight gap, said sight gap disposed along a length of said arm, said alignment arm attached to an opposite end of said brace, said sight gap adapted for positioning said alignment arm directly over a center of the golf ball.

2. The training device as described in claim 1 wherein said attachment means is a putter shaft attachment housing having a hinged cover, when said hinged cover is open, a portion of the putter shaft is received and held therein when said hinged cover is closed.

3. The training device as described in claim 2 further including a first brace and a second brace, one end of said braces releasably attached to a lower portion of said attachment housing, an opposite end of said braces attached to said ball alignment arm.

4. The training device as described in claim 1 wherein said ball alignment arm includes a first end, the first end having a telescoping first member with a pointed end.

5. The training device as described in claim 4 wherein said ball alignment arm includes a second end, the second end having a telescoping second member with a pointed end.

6. A golf putting training device for quickly attaching to a golf putter shaft of a golf putter and disposed above a putter head attached to a lower portion of the shaft, the training device used with a golf ball on a practice putting green, the training device comprising:

a putter shaft attachment housing adapted for adjustably mounting along the length of the golf putter shaft;

a first brace and a second brace, one end of said braces releasably attached to said attachment housing; and a ball alignment arm with a sight gap, said sight gap disposed along a center of a length of said arm, said alignment arm attached to an opposite end of said braces, said sight gap adapted for positioning said alignment arm directly over a center of the golf ball and next to the putter head.

7. The training device as described in claim 6 wherein said ball alignment arm includes a first end, the first end having a telescoping first member with a pointed end and a second end, the second end having a telescoping second member with a pointed end, said telescoping first and second members used as a guide for alignment in stroking the golf ball toward a golf cup.

8. The training device as described in claim 6 wherein said ball alignment arm is hinged in half for folding said ball alignment arm in half.

9. The training device as described in claim 6 wherein said alignment arm is hinged to the opposite end of said first and second braces, said first and second braces foldable next to a length of said alignment arm.

10. A golf putting training device for quickly attaching to a golf putter shaft of golf putter and disposed above a putter head attached to a lower portion of the shaft, the training device used with a golf ball on a practice putting green, the training device comprising:

a putter shaft attachment housing adapted for adjustably mounting along the length of the golf putter shaft;

a first brace and a second brace, one end of said braces releasably attached to said attachment housing; and a ball alignment arm with a sight gap, said sight gap disposed along a center of a length of said arm, said alignment arm attached to an opposite end of said braces, said sight gap adapted for positioning said alignment arm directly over a center of the golf ball and next to the putter head, said attachment housing having a ball centerline mark thereon for adjusting said attachment housing along a line parallel to the length of the putter shaft and positioning said ball alignment arm over the center of the golf ball.

11. The training device as described in claim 10 wherein said ball alignment arm includes a first end, the first end having a telescoping first member with a pointed end and extending outwardly therefrom and a second end, the second end having a telescoping second member with a pointed end extending outwardly therefrom, said telescoping first and second members used as a guide for alignment in stroking the golf ball toward a golf cup.

12. The training device as described in claim 10 wherein said ball alignment arm is hinged in half for folding said ball alignment arm in half.

13. The training device as described in claim 10 wherein said alignment arm is hinged to the opposite end of said first and second braces, said first and second braces foldable next to a length of said alignment arm.

* * * * *